US011292143B2

(12) United States Patent
Park et al.

(10) Patent No.: US 11,292,143 B2
(45) Date of Patent: Apr. 5, 2022

(54) RAZOR CARTRIDGE AND RAZOR ASSEMBLY USING THE SAME

(71) Applicant: DORCO CO., LTD., Seoul (KR)

(72) Inventors: Young Ho Park, Seoul (KR); Jae Joon Lee, Seoul (KR); Sung Hee Son, Seoul (KR); Shin Hwan Park, Seoul (KR)

(73) Assignee: DORCO CO., LTD., Seoul (KR)

( * ) Notice: Subject to any disclaimer, the term of this patent is extended or adjusted under 35 U.S.C. 154(b) by 7 days.

(21) Appl. No.: 15/931,793

(22) Filed: May 14, 2020

(65) Prior Publication Data

US 2020/0361105 A1 Nov. 19, 2020

(30) Foreign Application Priority Data

May 14, 2019 (KR) ..... 10-2019-0056275

(51) Int. Cl.

| | |
|---|---|
| ***B26B 21/48*** | (2006.01) |
| ***B26B 21/22*** | (2006.01) |
| ***B26B 21/40*** | (2006.01) |
| ***B26B 21/52*** | (2006.01) |

(52) U.S. Cl.

CPC ..... *B26B 21/48* (2013.01); *B26B 21/225* (2013.01); *B26B 21/405* (2013.01); *B26B 21/4018* (2013.01); *B26B 21/521* (2013.01); *B26B 21/526* (2013.01)

(58) Field of Classification Search

CPC ... B26B 21/48; B26B 21/225; B26B 21/4018; B26B 21/405; B26B 21/521; B26B 21/526

USPC ..... 30/34.05

See application file for complete search history.

(56) References Cited

U.S. PATENT DOCUMENTS

| | | | |
|---|---|---|---|
| 5,687,485 | A | 11/1997 | Shurtleff et al. |
| 5,761,814 | A | 6/1998 | Anderson et al. |
| 5,956,848 | A | 9/1999 | Tseng et al. |
| 5,956,851 | A | 9/1999 | Apprille et al. |
| 6,041,926 | A | 3/2000 | Petricca et al. |

(Continued)

FOREIGN PATENT DOCUMENTS

| | | |
|---|---|---|
| EP | 3094457 | 11/2016 |
| EP | 3351359 | 7/2018 |

(Continued)

OTHER PUBLICATIONS

Korean Intellectual Property Office Application No. 10-2019-0056275, Office Action dated Oct. 21, 2020, 5 pages.

(Continued)

*Primary Examiner* — Omar Flores Sanchez

(74) *Attorney, Agent, or Firm* — Lee, Hong, Degerman, Kang & Waimey PC

(57) ABSTRACT

The present disclosure provides a razor cartridge including at least one shaving blade having a cutting edge, a blade housing configured to accommodate the at least one shaving blade aligned in a transverse direction, a heated area formed at the blade housing, and comprising at least one heating pattern made of a conductive material, and a non-heated area formed at the blade housing made of a material different from the heated area, wherein the conductive material included in the at least one heating pattern is a conductive plastic or metallic material, and wherein the heated area is configured to generate heat by receiving electric power from a power supply.

13 Claims, 10 Drawing Sheets

(56) References Cited

U.S. PATENT DOCUMENTS

| | | | |
|---|---|---|---|
| 6,052,903 | A | 4/2000 | Metcalf et al. |
| 6,185,822 | B1 | 2/2001 | Tseng et al. |
| 6,212,777 | B1 | 4/2001 | Gilder et al. |
| 6,442,839 | B1 | 9/2002 | Tseng et al. |
| 6,516,518 | B1 | 2/2003 | Garraway et al. |
| 6,612,040 | B2 | 9/2003 | Gilder |
| 6,684,513 | B1 | 2/2004 | Clipstone et al. |
| 9,908,250 | B2 | 3/2018 | Hodgson et al. |
| 10,583,576 | B2 * | 3/2020 | Broemse ..... B26B 21/227 |
| 2006/0070242 | A1 | 4/2006 | Szczepanowski et al. |
| 2015/0068043 | A1 | 3/2015 | Gester et al. |
| 2020/0361106 | A1 * | 11/2020 | Broemse ..... B26B 21/48 |
| 2020/0376699 | A1 * | 12/2020 | Tomassetti ..... B26B 21/405 |

FOREIGN PATENT DOCUMENTS

| | | | |
|---|---|---|---|
| JP | 2018161556 | | 10/2018 |
| KR | 10-2014-0040880 | | 4/2014 |
| WO | 2015094616 | A1 | 6/2015 |
| WO | 2015108801 | A1 | 7/2015 |
| WO | 2015108801 | A4 | 7/2015 |

OTHER PUBLICATIONS

European Patent Office Application Serial No. 20174444.8, Search Report dated Oct. 19, 2020, 9 pages.

* cited by examiner

RAZOR CARTRIDGE AND RAZOR ASSEMBLY USING THE SAME

CROSS-REFERENCE TO RELATED APPLICATION

Pursuant to 35 U.S.C. § 119(a), this application claims the benefit of earlier filing date and right of priority to Korean Patent Application No. 10-2019-0056275, filed on May 14, 2019, the contents of which are hereby incorporated by reference herein its entirety.

TECHNICAL FIELD

The present disclosure in some embodiments relates to a razor cartridge and razor assembly using the same.

BACKGROUND

The statements in this section merely provide background information related to the present disclosure and do not necessarily constitute prior art.

In general, the feeling of warmth delivered to the user during shaving helps the user to have a more warm and comfortable shave.

Recently, various shaving products are in the market claiming to give a warm feeling to a user's skin when shaving. One of them is a razor cartridge that includes a separate heating element disposed on the blade housing (hereinafter referred to as "heated razor cartridge").

Specifically, the conventional heated razor cartridge has a heating member which is disposed in front of a guard and is heated, and the heated heating member is configured to deliver a warm feeling to the user by directly contacting the skin.

However, the conventional heated razor cartridge has an issue that it needs a larger blade housing to secure a space in which the heating member is disposed.

An enlarged blade housing makes precise shaving difficult for a narrow region or a curvy region.

In addition, the conventional heated razor cartridge requires an additional process for mounting the heating member on the blade housing, resulting in increased complexity during production.

In addition, the conventional heated razor cartridge has its heating member externally exposed, making it vulnerable to an external shock or susceptible to damage, and accordingly, it is weak in durability.

In other conventional heated razor cartridges, a metallic heating member is disposed in front of a rubber guard.

In this case, when shaving, the heating member and the guard rubber provide different tactile sensations which are sequentially contacted with the skin, thereby causing the user to feel inconsistent tactility.

SUMMARY

In accordance with at least one embodiment, the present disclosure provides a razor cartridge including at least one shaving blade having a cutting edge, a blade housing, a heated area, and a non-heated area. The blade housing is configured to accommodate at least one shaving blade in a transverse direction. The heated area is formed in at least some of the blade housing and includes at least one heating pattern including a conductive material. The non-heated area is formed on at least some of the blade housing excluding the heated area and is composed of a component different from the heated area. The conductive material included in the heating pattern includes at least one of conductive plastics and metallic materials. The heated area is configured to generate heat by receiving electric power from an external power supply.

In one embodiment, the present disclosure includes at least one shaving blade having a cutting edge, a blade housing configured to accommodate the at least one shaving blade aligned in a transverse direction, a heated area formed at the blade housing, and comprising at least one heating pattern made of a conductive material, and a non-heated area formed at the blade housing made of a material different from the heated area, wherein the conductive material included in the at least one heating pattern is a conductive plastic or metallic material, and wherein the heated area is configured to generate heat by receiving electric power from a power supply.

In another embodiment, a razor assembly is provided comprising at least one shaving blade having a cutting edge, a blade housing configured to accommodate the at least one shaving blade aligned in a transverse direction and comprising a first heating pattern and a second heating pattern, wherein the first heating pattern and the second heating pattern are configured to generate heat by receiving electric power from a power supply, and a razor handle coupled to the razor cartridge, wherein the blade housing further comprises a link pattern at the rear side of the blade housing and electrically connected with the second heating pattern, and wherein the razor handle comprises a power transmit portion electrically connected with the link pattern.

DETAILED DESCRIPTION

Figure 1:
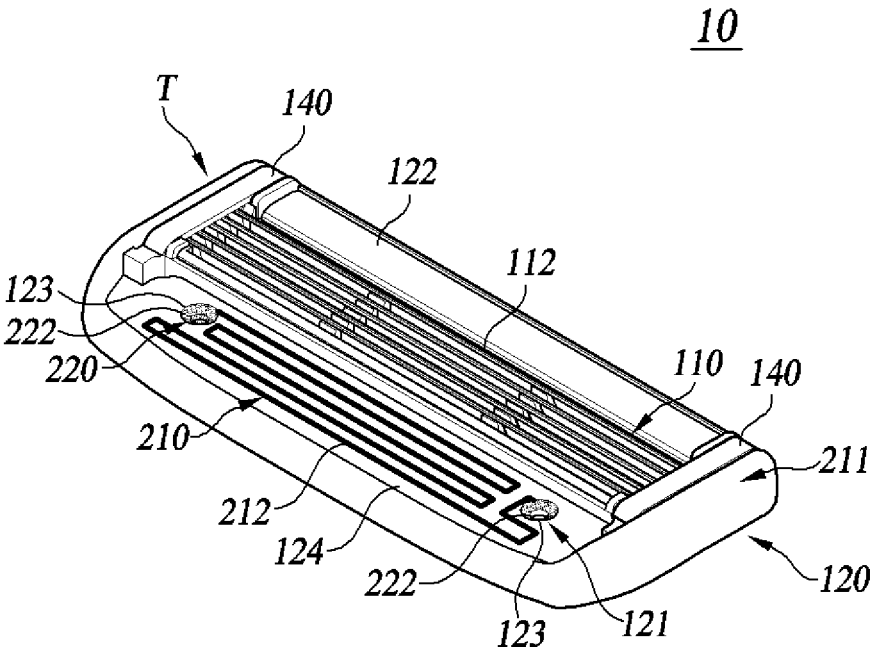
FIG. 1 is a front perspective view of a razor cartridge according to at least one embodiment of the present disclosure.

The present disclosure provides a heated razor cartridge with a reduced overall size providing a comfortable shave without giving inconsistent tactility to a user by forming the heated area integrally with the blade housing.

In addition, the present disclosure improves efficiency during production and durability of the razor cartridge by forming the heated area integrally with the blade housing.

Exemplary embodiments of the present disclosure are described below with reference to the accompanying drawings. In the following description, like reference numerals designate like elements where possible, although the elements are shown in different drawings. Further, in the following description of the at least one embodiment, a detailed description of known functions and configurations incorporated herein will be omitted for the purpose of clarity and for brevity.

Additionally, various terms such as first, second, i), ii), (a), (b), etc., are used solely for the purpose of differentiating one component from the other but not to imply or suggest the substances, the order, or sequence of the components. Throughout this specification, when a part "includes" or "comprises" a component, the part is meant to further include other components, not excluding thereof unless there is a particular description contrary thereto.

FIG. 1 is a front perspective view of a razor cartridge 10 according to at least one embodiment of the present disclosure.

Figure 2:
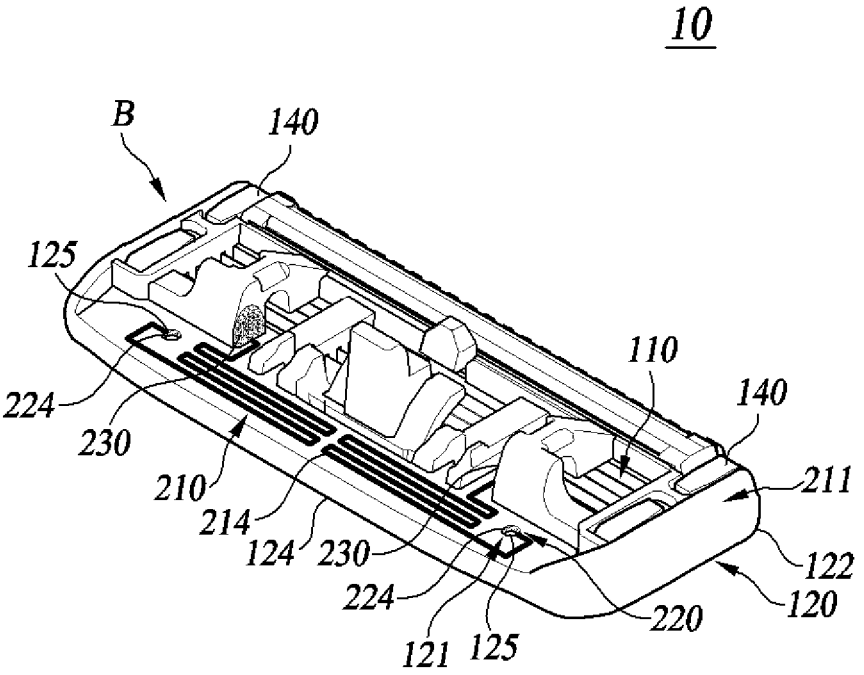
FIG. 2 is a rear perspective view of a razor cartridge according to at least one embodiment of the present disclosure.

FIG. 2 is a rear perspective view of the razor cartridge 10 according to at least one embodiment of the present disclosure.

As shown in FIGS. 1 and 2, the razor cartridge 10 may include one or more shaving blades 110, a blade housing 120, a clip 140, a heated area 210, and a non-heated area 211.

The blade housing 120 may accommodate at least one or more shaving blades 110 having a cutting edge 112.

Specifically, the one or more shaving blades 110, referred to sometimes as "the shaving blades 110," may be accommodated on opposite sides of the blade housing 120 retained therein by a plurality of clips 140.

The blade housing 120 may include a cap 122 and a guard 124.

The cap 122 may be located at the rear of the shaving blades 110, and specifically, may be disposed at a front side 'T' of the blade housing 120.

The guard 124, on front side 'T' of the blade housing 120, may be located in front of the shaving blade 110. The term front side and rear side may be used to refer to opposite sides of the blade housing, and the directional terms front and rear are used with respect to a direction the cartridge is moved in a shaving direction along a user's face during shaving.

The guard 124, during shaving may stretch the skin in the direction of shaving before the hairs are cut by the one or more shaving blades 110.

This allows the user's body hair to be erected in a direction perpendicular to the user's skin surface, whereby the one or more shaving blades 110 can cut the body hair more easily.

The clips 140 may support the shaving blades 110 to the blade housing 120. This can prevent the shaving blades 110 from being detached from the blade housing 120.

The heated area 210 may be formed on at least some of the blade housing 120.

In addition, the non-heated area 211 may be formed on at least some of the blade housing 120 other than the heated area 210.

In the present disclosure, the heated area 210 refers to an area on the blade housing 120 in which an electric current may flow and can be heated by the current flowing therein, and the non-heated area 210 refers to an area on the blade housing 120 in which no current flows or a very small amount of current flows therein, which is not substantially heated by the current.

Specifically, the heated area 210 may include a heating pattern and a pattern periphery.

In this case, the heating pattern may route the current flowing in the heated area 210, which may heat not only the heating pattern but also the periphery of the heating pattern. Accordingly, the heated area 210 refers to an area on the blade housing 120, which is capable of transferring heat to the user's skin by the heating pattern and the periphery that is heated through the heating pattern. The heated area 210 and the non-heated area 211 may be composed of different components.

For example, the heated area 210 may include a conductive material, and the non-heated area 211 may include a non-conductive material.

In the present specification, the conductive material refers to a material having a relatively high electrical conductivity, and the non-conductive material refers to a material that has no or very low electrical conductivity compared to the conductive material.

In one embodiment, the conductive material included in the heated area 210 may include one or more of conductive plastics or metallic materials.

In one embodiment, the metal material may include all metals having electrical conductivity such as copper, nickel, tungsten, zinc, silver, iron, and the like.

Components constituting the heated area 210 may be made of a material having a higher density than components constituting the non-heated area 211.

For example, in an embodiment the heated area 210 is made of a metal material, and the non-heated area 211 may be made of non-conductive plastic having a lower density than the metal material constituting the heated area 210.

The resistance value of the conductive material included in the heated area 210 may be 0.1Ω to 100Ω, preferably 1Ω to 20Ω, and more preferably 2Ω to 10Ω.

The heated area 210 and the non-heated area 211 may be integrally formed with the blade housing 120.

In the present specification, two components being integrally formed refers to components which are manufactured through the same manufacturing process or where one component is directly manufactured on another component, so that separation of the components is impossible or very difficult.

For example, the conductive material included in the heated area 210 may be printed or plated on the blade housing 120, in which case, the conductive material can be seen as integrally formed in the blade housing 120.

As shown in FIG. 2, the heating pattern of the heated area 210 may include a first heating pattern 212 and a second heating pattern 214.

The first heating pattern 212 and the second heating pattern 214 may include a conductive material which may include one or more of conductive plastics and metallic materials.

The first heating pattern 212 may be disposed at the front side 'T' of the blade housing 120, and the second heating pattern 214 may be disposed at a rear side 'B' of the blade housing 120.

The first heating pattern 212 may heat front side 'T' of the blade housing 120, which in turn heats the user's skin that is in contact with the razor cartridge 10.

The second heating pattern 214 may heat rear side 'B' of the blade housing 120.

When both front side 'T' and rear side 'B' of the blade housing 120 are heated by the heating patterns 212 and 214, front side 'T' and rear side 'B' can have a smaller temperature difference therebetween compared to when only one side of the blade housing 120 is heated.

On the other hand, the amount of heat transferred by the heat conduction method may be greater as the temperature gradient increases.

Therefore, when front side 'T' and rear side 'B' of the blade housing 120 are both heated by the heating patterns 212 and 214, the amount of heat transferred to rear side 'B' can be further reduced compared to when only one side of the blade housing 120 is heated.

Since the amount of heat generated in the first heating pattern 212 is constant, the amount of heat transferred from the first heating pattern 212 to front side 'T' of the blade housing 120 may increase, whereby the first heating pattern 212 may heat the user's skin more effectively.

In addition, when the heating patterns 212 and 214 constitute a single serial wire, the greater the resistance, the greater the power, that is, the heat generation. Therefore, arranging the second heating pattern 214 at the rear side 'B' of the blade housing 120 can increase the overall resistance of the heating patterns 212 and 214, whereby front side 'T' of the blade housing 120 has the effect of heating faster.

At least some of the second heating pattern 214 may overlap with the first heating pattern 212.

In this case, the region of front side 'T' heated by the first heating pattern 212 may overlap with at least some of the region of rear side 'B' heated by the second heating pattern 214.

This can further reduce the amount of heat transferred from the first heating pattern 212 to rear side 'B' of the blade housing 120, whereby a larger amount of heat may be transferred from the first heating pattern 212 to rear side 'T' of the blade housing 120.

The heating temperature of the first heating pattern 212 and the second heating pattern 214 may be 25° C. to 75° C., but the present disclosure is not so limited.

FIGS. 1 and 2 illustrate the second heating pattern 214 as heating rear side 'B' of the blade housing 120, but the present disclosure is not so limited.

For example, the razor cartridge 10 may not include the second heating pattern 214 or, even if it does, it may not substantially heat rear side 'B' of the blade housing 120.

The first heating pattern 212 and the second heating pattern 214 may be formed in a meandering pattern or a straight line.

At least some of the heating patterns 212 and 214 may have a spacing of pattern lines adjacent to each other in the range of 0.01 mm to 40 mm, and preferably, in the range of 0.1 mm to 10 mm.

The first heating pattern 212 and the second heating pattern 214 have a meandering pattern to prolong the lengths of the entire wires constituting the heating patterns 212 and 214.

This allows the heating patterns 212, 214 to have a suitable resistance value for heating the skin of the user.

The width of the conducting wires constituting the heating patterns 212 and 214 may be 0.01 mm to 2 mm, and preferably, 0.1 mm to 0.8 mm, however this disclosure is not limited to these.

The heating patterns 212 and 214 may be formed with two or more metal wires that are laminated. In this case, the thickness of the wire of each layer forming the heating patterns 212 and 214 may vary depending on the physical properties of the metallic material constituting each wire.

For example, when a nickel (Ni) wire and a copper (Cu) wire are laminated to form the heating patterns 212 and 214, the nickel wire has a thickness of 1.0 μm to 2.0 μm, and the copper wire may have a thickness of 3 μm to 10 μm, although the present disclosure is not so limited.

An insulating film may be coated on top of the heating patterns 212 and 214 so that they are not externally exposed.

Alternatively, separate cover members such as an anterior guard (FIG. 3A at 130) and a posterior cover (FIG. 4A at 150) may be disposed above the heating patterns 212 and 214 for protection.

The first heating pattern 212 and the second heating pattern 214 according to at least one embodiment of the present disclosure may by formed integrally with the blade housing 120 by employing a molded interconnect device (MID) or laser direct structuring (LDS) method using printing or laser etching and electroless plating processes.

Referring back to FIGS. 1 and 2, the blade housing 120 may include a pattern link 220.

The pattern link 220 may electrically connect the first heating pattern 212 with the second heating pattern 214.

The first heating pattern 212 and the second heating pattern 214 may constitute a single serial wire passing between the front side T and the rear side B via the pattern link 220.

The pattern link 220 may include a conductive material which may include at least one of conductive plastics and metallic materials.

The pattern link 220 may electrically connect the first heating pattern 212 with the second heating pattern 214 through a through hole 121 of the blade housing 120, although the configuration of the pattern link 220 of the present disclosure is not so limited.

In one embodiment, the pattern link 220 may be composed of a plurality of conducting wires bypassing along a lateral side surface of the blade housing 120. In this case, the first heat generation pattern 212 and the second heat generation pattern 214 may be electrically connected by these conducting wires.

FIGS. 1 and 2 illustrate the first heating pattern 212 and the second heating pattern 214 as being connected in series, but the present disclosure is not so limited. For example, the first heating pattern 212 and the second heating pattern 214 may be connected in parallel.

Figure 3A:
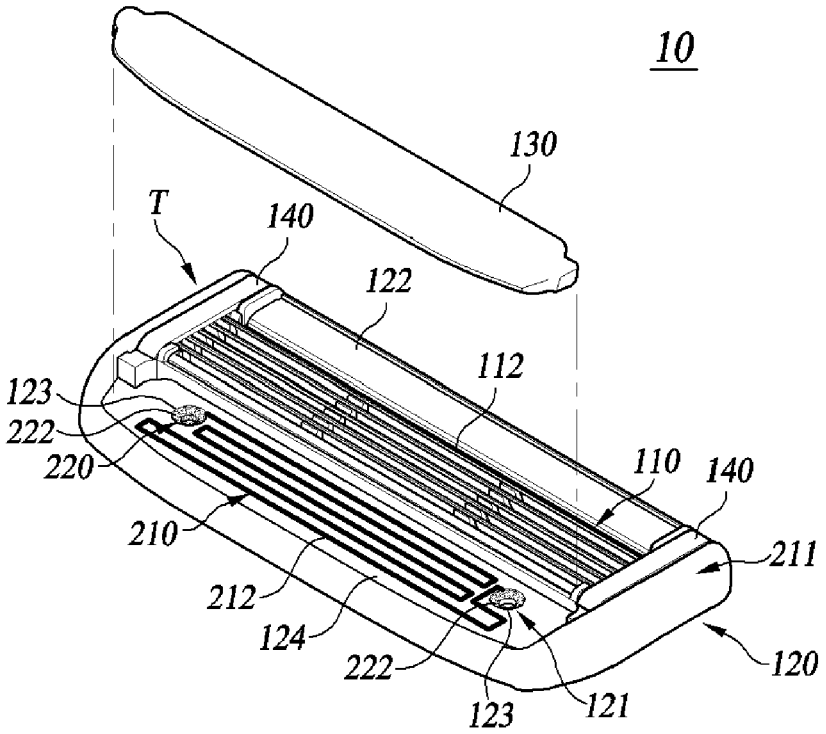
FIGS. 3A and 3B are diagrams illustrating an anterior guard mounted on a razor cartridge according to at least one embodiment of the present disclosure.
Figure 3B:
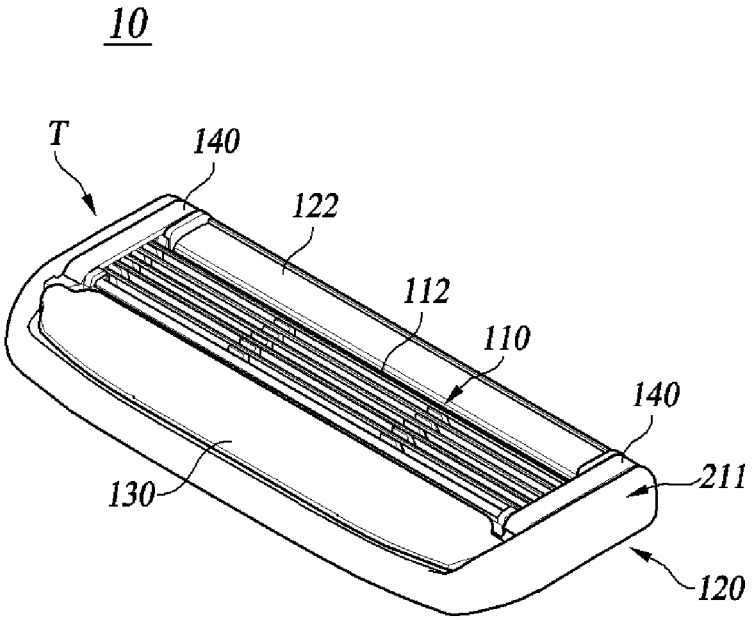

FIGS. 3A and 3B are diagrams illustrating that an anterior guard 130 is mounted toward a front of the razor cartridge 10 at the front side T according to at least one embodiment of the present disclosure.

Specifically, FIG. 3A shows a state of the anterior guard 130 separated from the blade housing 120, and FIG. 3B shows the anterior guard 130 being mounted on the blade housing 120.

As shown in FIG. 3A and FIG. 3B, the razor cartridge 10 may incorporate the anterior guard 130.

The anterior guard 130 may be disposed on a front side 'T' of the blade housing 120 in the front of the shaving blade 110. Specifically, the anterior guard 130 may be disposed to cover at least some area of the guard 124 of the blade housing 120.

The anterior guard 130 may be made of, but not limited to an elastic material such as rubber. For example, the anterior guard 130 may be made of plastic or metal.

The anterior guard 130 may overlap with at least some of the heated area 210. This can transfer more heat from the heated area 210 through the anterior guard 130 to the user's skin.

The first heating pattern 212 may be completely covered by the anterior guard 130, and accordingly, the first heating pattern 212 may not be exposed at the front side 'T' of the blade housing 120.

This allows the anterior guard 130 to serve as a cover member protecting the first heating pattern 212, whereby protecting the first heating pattern 212 from external shocks.

In addition, the first heating pattern 212 when disposed under the anterior guard 130 does not require a separate space for its placement on the blade housing 120, which can reduce the overall size of the blade housing 120.

In FIGS. 3A and 3B, the anterior guard 130 is illustrated as being an I-shape to cover the first heating pattern 212 disposed in the region of the guard 124, but the present disclosure is not limited to this shape.

For example, the anterior guard 130 may conform to the shape of the first heating pattern 212 by having a U-shape surrounding a part of the circumference, or along three sides, of the blade housing 120 or an O-shape surrounding the entire circumference of the blade housing 120.

In FIGS. 3A and 3B, front side 'T' of the blade housing 120 is formed with a concave space for accommodating the anterior guard 130 which then serves as a guard, but the present disclosure is not so limited.

For example, the blade housing 120 may leave out the anterior guard 130 and have an insulating or protective film coated directly on top of the first heating pattern 212.

In this case, front side 'T' of the blade housing 120 does not have a concave space for accommodating the anterior guard 130, and the first heating pattern 212, with the film, directly serves as a guard by contacting the user's skin.

Figure 4A:
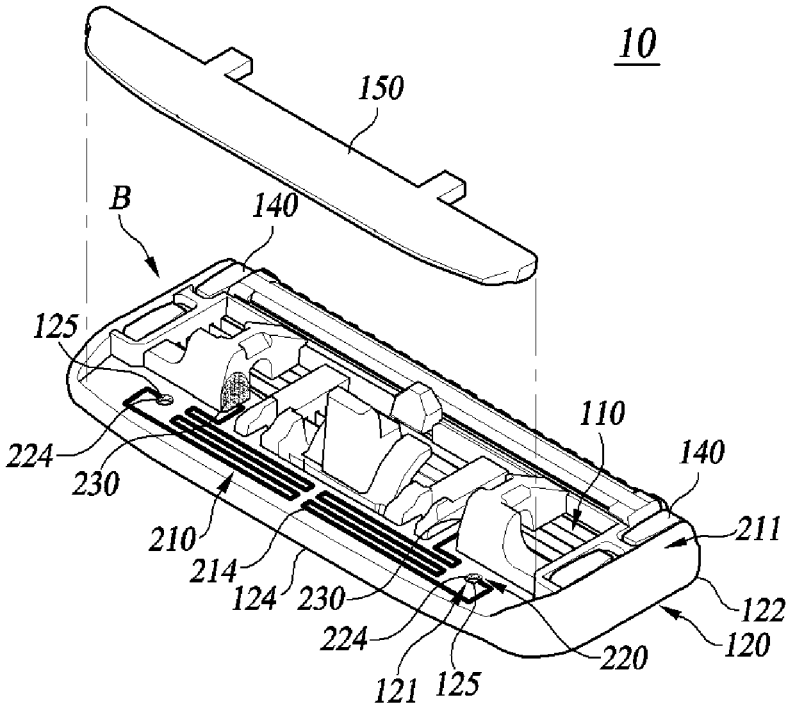
FIGS. 4A and 4B are diagrams illustrating a posterior cover mounted on a razor cartridge according to at least one embodiment of the present disclosure.
Figure 4B:
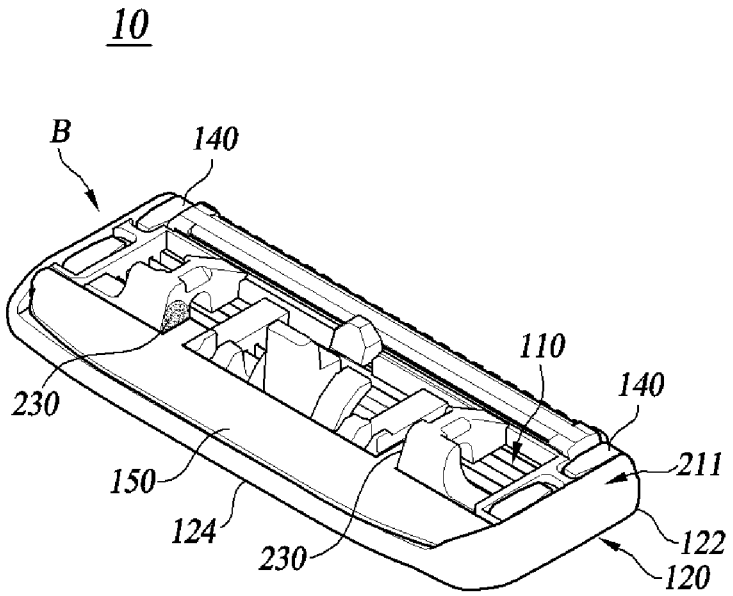

FIGS. 4A and 4B are diagrams illustrating that the posterior cover 150 is mounted on the rear of the razor cartridge 10 according to at least one embodiment of the present disclosure.

Specifically, FIG. 4A shows a state of the posterior cover 150 separated from the blade housing 120, and FIG. 4B shows the posterior cover 150 being mounted on the blade housing 120.

As shown in FIG. 4A and FIG. 4B, the razor cartridge 10 may incorporate the posterior cover 150.

The posterior cover 150 may be disposed on rear side 'B' of the blade housing 120.

The second heating pattern 214 may be completely covered by the posterior cover 150, and accordingly, the second heating pattern 214 may not be exposed at the rear side 'B' of the blade housing 120.

In this case, the second heating pattern 214 may be protected from external shock by being disposed under the posterior cover 150.

Figure 5:
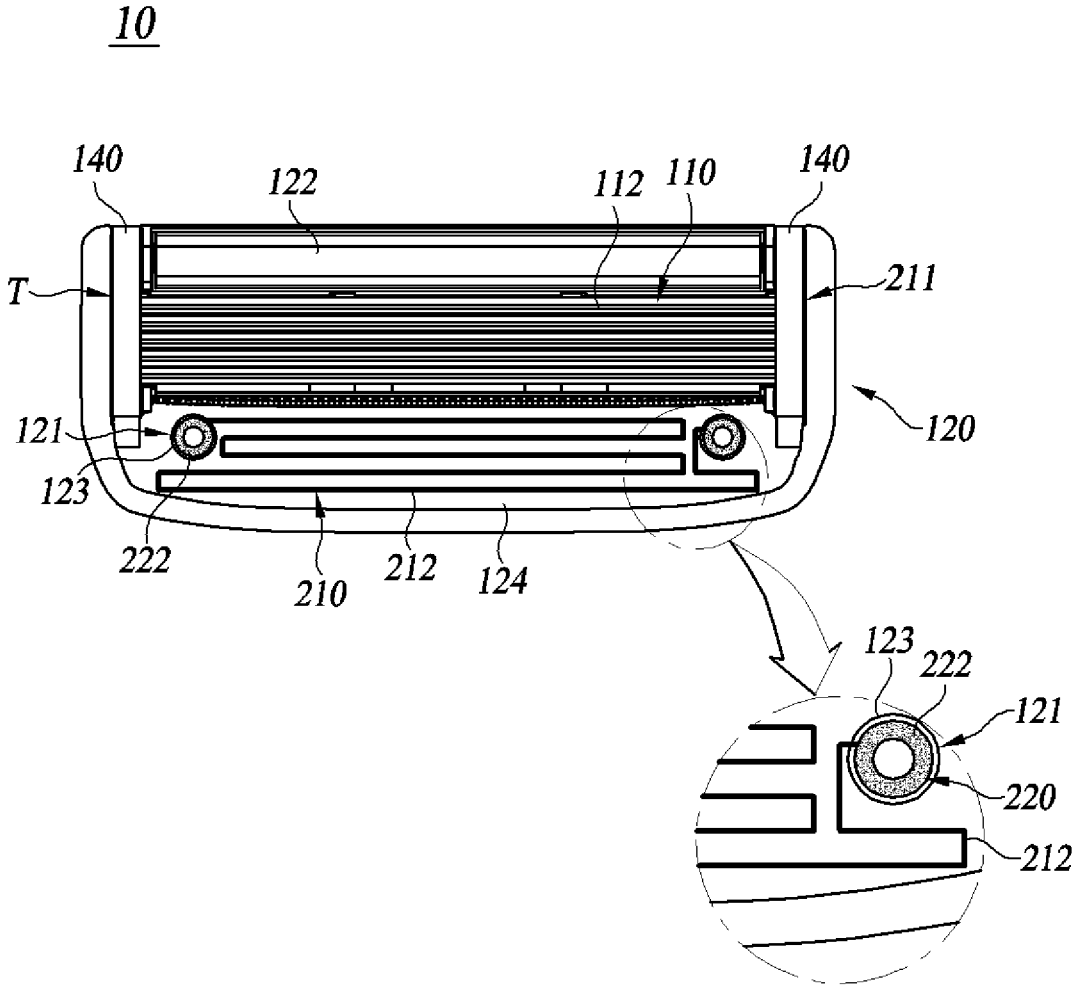
FIG. 5 is a front view of a razor cartridge according to at least one embodiment of the present disclosure.

FIG. 5 is a front view of the razor cartridge 10 according to at least one embodiment of the present disclosure. In FIG. 5, for convenience of description, the anterior guard 130 is omitted.

Figure 6:
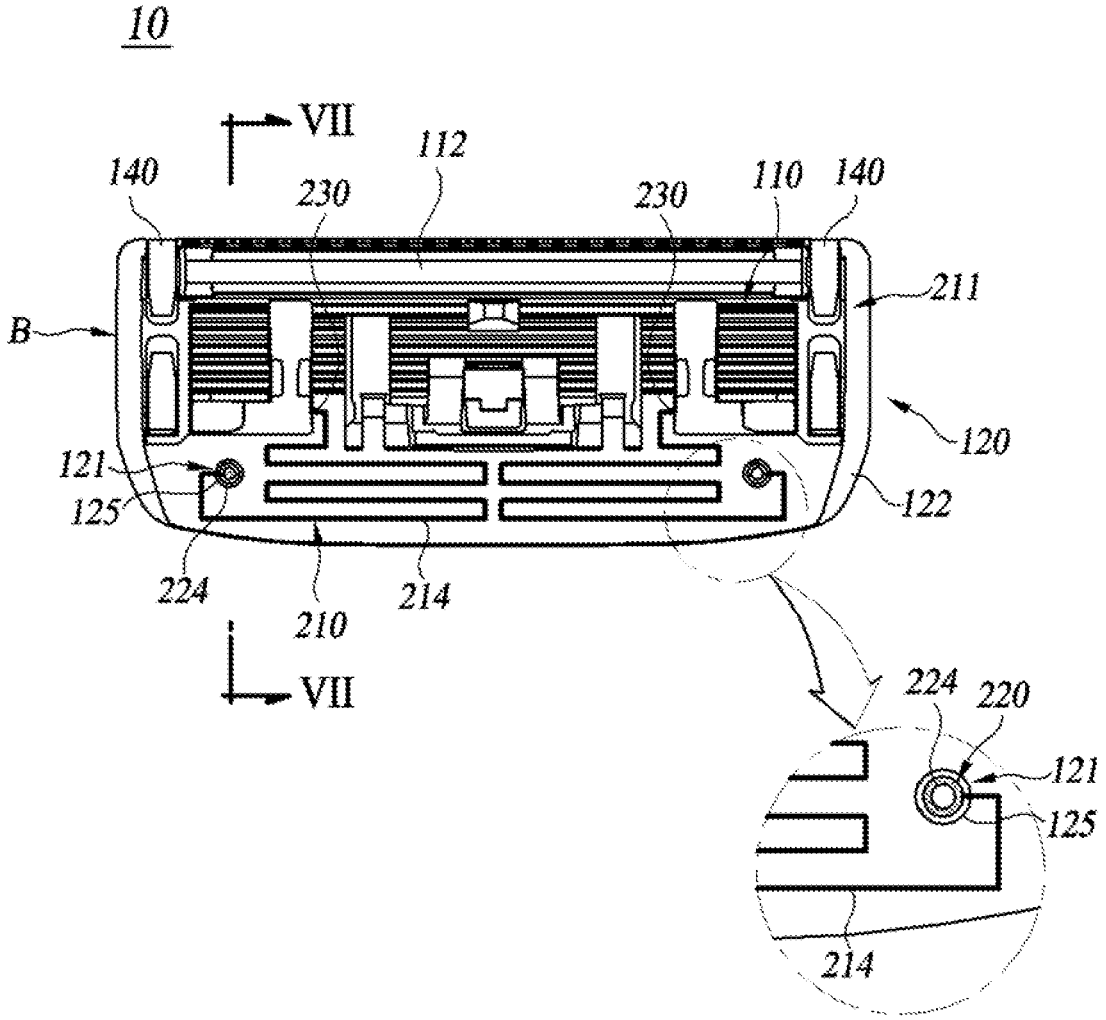
FIG. 6 is a rear view of a razor cartridge according to at least one embodiment of the present disclosure.

FIG. 6 is a rear view of the razor cartridge 10 according to one embodiment of the present disclosure. In FIG. 6, for convenience of description, the posterior cover 150 is omitted.

As shown in FIGS. 5 and 6, the through hole 121 may be defined by a first aperture 123 and a second aperture 125.

The first aperture 123 may be formed on front side 'T' of the blade housing 120, and it may have a recessed shape.

The second aperture 125 may be formed on rear side 'B' of the blade housing 120.

The pattern link 220 may include at least one first link pattern 222 and at least one second link pattern 224.

At least some of the pattern link 220 may be integrally formed with the surface of the through hole 121 corresponding to at least some of the blade housing 120.

For example, the first link pattern 222 may be formed integrally with the first aperture 123 on front side 'T' of the blade housing 120, and it may be electrically connected to the second link pattern 224 and the first heating pattern 212.

Specifically, the first link pattern 222 may be integrally formed on the first aperture 123 by employing the Molded Interconnect Device (MID) or Laser Direct Structuring (LDS) methods using the printing or laser etching and electroless plating processes.

Specifically, MID refers to a three-dimensionally manufactured component that typically includes a plastic component and an electronic circuit trace. According to the MID method, a plastic substrate or housing may be built first, and an electrical circuit or device may be plated or stacked thereon.

The MID may be manufactured through LDS. Specifically, the LDS method may include an injection molding step, a laser activation step on a thermoplastic material, and a metallization step through electroless plating.

The second link pattern 224 may be formed integrally with rear side 'B' of the blade housing 120, and may be electrically connected to the first link pattern 222 and the second heating pattern 214.

Specifically, the second link pattern 224 may be integrally formed on the second aperture 125 by employing the MID or LDS method using the printing or laser etching and electroless plating processes.

The razor cartridge 10 according to at least one embodiment of the present disclosure obviates the need for a separate intermediate conductor penetrating the blade housing 120 through forming the link patterns 222 and 224 integrally with the surface of the through hole 121, through which the two heating patterns 212 and 214 on opposite sides of the blade housing are electrically connected.

This can improve the durability of a region connecting the first heating pattern 212 and the second heating pattern 214.

In addition, saving the process of inserting an intermediate conductor into the blade housing 120 or the process of connecting both ends of the intermediate conductor to the respective heating patterns 212 and 214 leads to improved efficiency during production of the razor cartridge 10.

In an embodiment, the blade housing 120 may include at least one third link pattern 230.

The third link pattern 230 may include a conductive material which may include at least one of conductive plastics and metallic materials.

The third link pattern 230 may be formed integrally with, and as at least a portion of the blade housing 120 on rear side 'B' of the blade housing 120, and it may be electrically connected with the second heating pattern 214.

Although the present disclosure is not limited to a particular configuration or numerical value, in one embodiment, the first heating pattern 212, second heating pattern 214, first link pattern 222, second link pattern 224, and third link pattern 230 may constitute a single conducting wire which has a total area of 10 $mm^2$ to 2,000 $mm^2$.

The third link pattern 230 may be electrically connected to a power transmit portion (FIG. 8 at 816) of a razor handle (FIG. 8 at 800).

Through this configuration, the third link pattern 230 may receive electric power from the power supply (FIG. 8 at 822) of the razor handle 800 and energize the conducting wire constituted by the plurality of patterns 212, 214, 222, 224, and 230.

The first heating pattern 212, second heating pattern 214, first link pattern 222, second link pattern 224, and third link pattern 230 may be integrally formed with at least some of the blade housing 120. For this purpose, the MID or LDS method using printing or laser etching and electroless plating processes may be employed.

The pattern surface corresponding to the respective patterns 212, 214, 222, 224, and 230 may be formed on the blade housing 120, and printing or electroless plating may be performed on the pattern surface to plate metals such as copper, nickel, and aluminum thereon.

The razor cartridge 10 according to at least one embodiment of the present disclosure is desirably configured such that the respective patterns 212, 214, 222, 224, and 230 are integrally formed with at least some of the blade housing 120, which is achieved by employing the MID or LDS method using printing or laser etching and electroless plating processes.

This, when compared to traditional methods of attaching a separate PCB member formed with the heating pattern to the blade housing, embodiments of the present disclosure provide improved durability of the heating patterns 212 and 214 and improved efficiency during production.

From FIG. 1 to FIG. 6, the method of manufacturing the MID is illustrated as an LDS method, but the MID manufacturing method of the present disclosure is not limited to the LDS method.

For example, MIDs according to the present disclosure may also be produced through two-shot molding, microscopic integrated processing (MIP), and a laser developed additive technology, and the like.

Figure 7A:
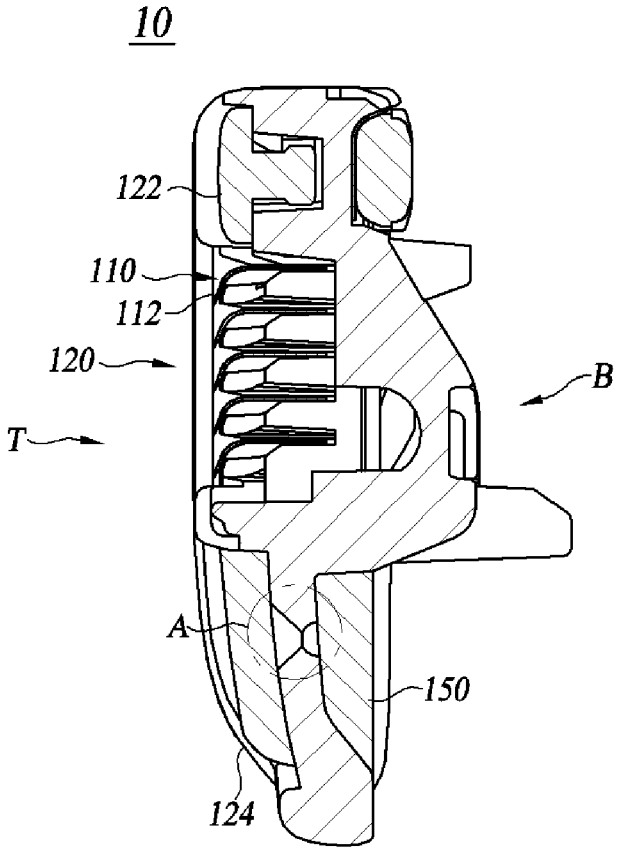
FIGS. 7A and 7B illustrate a side cross-sectional view and a partially enlarged view of a razor cartridge according to at least one embodiment of the present disclosure showing a cross-section in the direction VII-VII in FIG. 6.
Figure 7B:
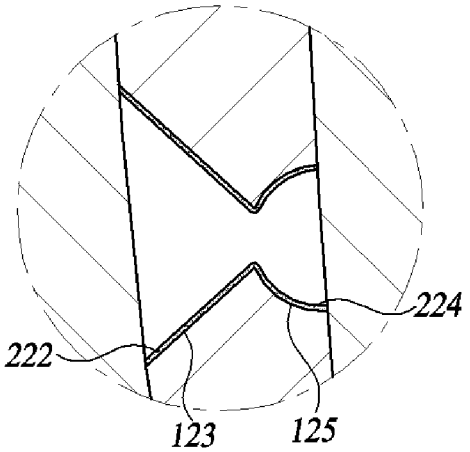

FIG. 7A illustrates a side cross-sectional view and FIG. 7B illustrates a partially enlarged view of the razor cartridge 10 according to at least one embodiment of the present disclosure showing a cross-section in direction VII-VII in FIG. 6.

Specifically, FIG. 7A shows a side sectional view of the razor cartridge 10 and FIG. 7B shows a partially enlarged view of area 'A' at FIG. 7A.

As shown in FIG. 7A and FIG. 7B, with respect to front side 'T' and rear side 'B' of the blade housing 120, the first link pattern 222 and the second link pattern 224 may be positioned at apertures of the through hole having recessed shapes.

Specifically, as the depths of the first link pattern 222 and the second link pattern 224 are increased, the surface areas of the first link pattern 222 and the second link pattern 224 may be decreased.

In this case, the respective angle formed at the connection regions between the first heating pattern 212 and the first link pattern 222, and between the second heating pattern 214 and the second link pattern 224 are larger than when the link patterns 222 and 224 have a straight cylindrical shape.

Larger angles between the heating patterns 212, 214 and the link patterns 222, 224, respectively, allow for improved efficiency during the printing or plating operations on the connection location, and an issue of locally forming the printing or plating too thickly is avoided. Accordingly, uniform thickness of the conductive wires formed by the plurality of patterns 212, 214, 222, 224, and 230 may be achieved.

The respective apertures 123 and 125 on which the link patterns 222 and 224 are formed may have their recessed shapes corresponding to the link patterns 222 and 224.

In this case, the first link pattern 222 may be electrically connected with the second link pattern 224 even when the size of the first aperture 123 at front side 'T' of the blade housing 120 is different from that of the second aperture 125 on rear side 'B' of the blade housing 120.

This provides efficiency during production than when the apertures 123 and 125 and through hole have a cylindrical shape.

FIGS. 1 to 7 illustrate the heating patterns 212 and 214 as being electrically connected through the link patterns 222 and 224 penetrating the blade housing 120, although the present disclosure is not limited thereto.

For example, in another embodiment, the first heating pattern 212 and the second heating pattern 214 may not use the through hole 121 but separate connecting wires detouring along the side surface of the blade housing 120 for interconnecting the heating patterns electrically. Detailed description thereof will be presented in connection with FIGS. 11 and 12.

Figure 8A:
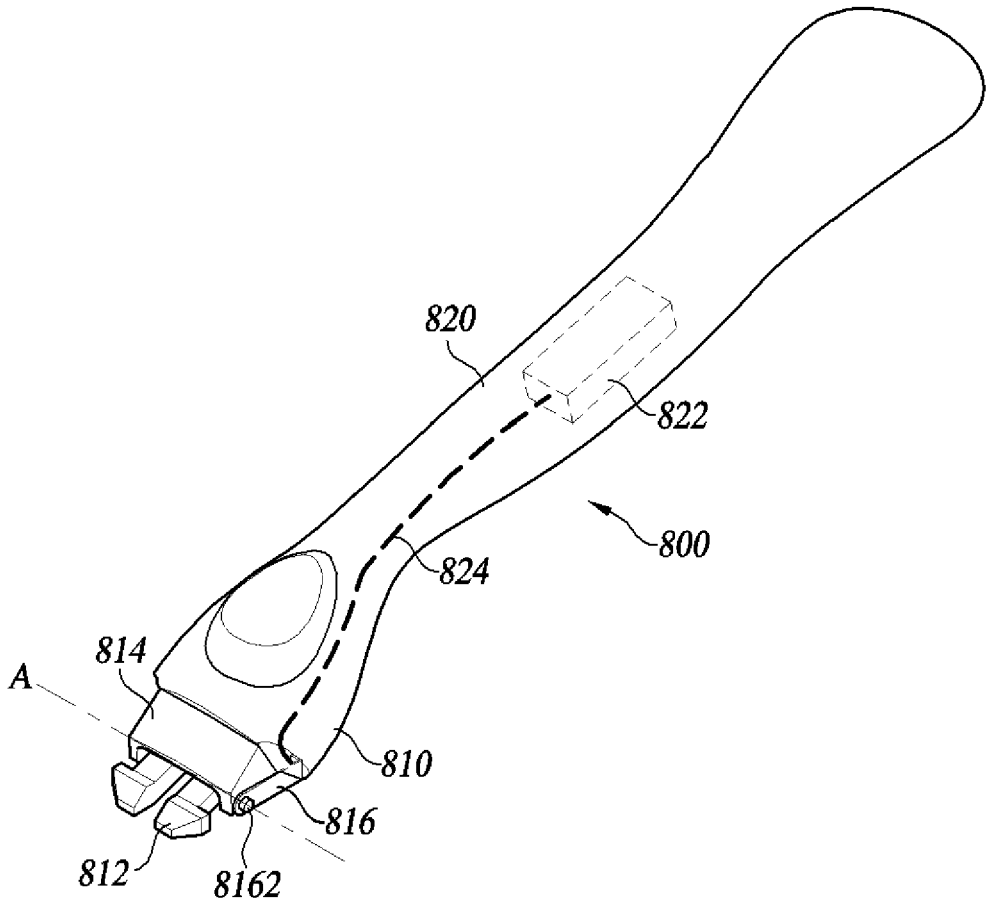
FIG. 8A is a perspective view of a razor handle according to at least one embodiment of the present disclosure.
Figure 8B:
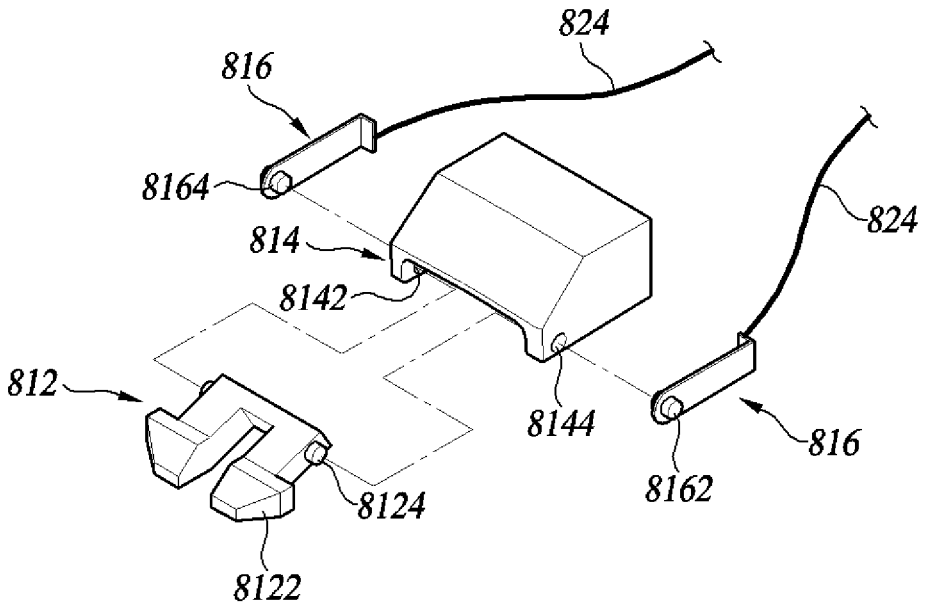
FIG. 8B is an exploded perspective view of the embodiment discussed in FIG. 8A.

FIGS. 8A and 8B are perspective views of a razor handle 800 according to one embodiment of the present disclosure.

Specifically, FIG. 8A shows the razor handle 800 with all the components assembled, and FIG. 8B is an exploded view showing the razor handle 800 with some of the components disassembled.

As shown in FIG. 8A, the razor handle 800 may include a head portion 810 and a gripping portion 820.

The head portion 810 may be an area on the razor handle 800, which is coupled to the razor cartridge 10.

The head portion 810 may include a cartridge connection 812, a connecting plate 814, and at least one power transmit portion 816.

The cartridge connection 812 may be coupled to the razor cartridge 10 so as to be pivotable relative to the razor cartridge 10 about a rotation axis 'A' parallel to the transverse direction.

This enables the razor cartridge 10 to pivot relative to the razor handle 800, between the first position and the second position, about rotation axis 'A'.

The connecting plate 814 may be fixedly coupled with the gripping portion 820, and it may be internally and externally coupled with the cartridge connection 812 and power transmit portions 816, respectively.

The power transmit portions 816 may be electrically connected to the third link patterns 230 of the blade housing 120 in order to deliver the power transmitted from the power supply 822 to the electric wire constituted by a plurality of patterns 212, 214, 222, 224, and 230.

Specifically, the power transmit portion 816 may be electrically connected to and energized by the power supply 822 through the electric wire 824.

Each power transmit portion 816 may transmit power transmitted from the power supply 822 to each third link pattern 230 through a transmission protrusion 8162.

To this end, the power transmit portion 816 may be made of a conductive material through which current can flow.

Between the first position and the second position, the rotation axis 'A' may penetrate the regions in which the third link pattern 230 and the power transmit portion 816 are interconnected.

In this case, even if the razor cartridge 10 rotates with respect to the razor handle 800 about the rotation axis 'A', the third link pattern 230 and the power transmit portion 816 may remain electrically connected.

Thus, the power transmitted from the power supply 822 may be delivered smoothly to the electric wire formed by the plurality of patterns 212, 214, 222, 224, and 230.

The gripping portion 820 may provide an area for gripping a razor assembly to a user when shaving and house the power supply 822 therein.

The power supply 822 may supply power to the electric wire formed by the plurality of patterns 212, 214, 222, 224, and 230 through the power transmit portions 816, thereby heating the heated area 210.

The power supply 822 may receive power generated from a lithium ion (Li-ion) battery or other power source.

The lithium ion battery may have a voltage of 2.4 V to 4.4 V. The voltage of the lithium ion battery may be controlled through a printed circuit board (PCB) according to a resistance value or a current value of the heated area, but the present disclosure is not so limited.

As shown in FIG. 8B, the cartridge connection 812 may include at least one connecting protrusion 8122 and pivot protrusions 8124.

The connecting protrusion 8122 may be an area on the cartridge connection 812, which is coupled to the razor cartridge 10. The cartridge connection 812 may be coupled with the razor cartridge 10 through the connecting protrusions 8122 into a fixed position.

The pivot protrusions 8124 may be the regions on the cartridge connection 812 which are coupled with the connecting plate 814.

Specifically, the pivot protrusions 8124 may be inserted into inner connecting holes 8142 formed inside the connecting plate 814.

When engaged, the pivot protrusion 8124 and the inner connecting hole 8142 may together define rotation axis 'A'.

Accordingly, with the pivot protrusions 8124 being inserted into the inner connecting holes 8142, the cartridge connection 812 may rotate about rotation axis 'A' with respect to the connecting plate 814.

Thus, the razor cartridge 10 fixedly coupled to the cartridge connection 812 may rotate with respect to the razor handle 800 about rotation axis 'A'.

The connecting plate 814 may include outer connecting holes 8144 as well as the inner connecting hole 8142.

The inner connecting holes 8142 may be formed inside the connecting plate 814.

Into the inner connecting holes 8142, the pivot protrusions 8124 of the cartridge connection 812 may be inserted, whereby defining rotation axis 'A'.

Outer connecting holes 8144 may be formed on the outer sides of the connecting plate 814.

Into the outer connecting holes 8144, inner protrusions 8164 of the power transmit portion 816 may be inserted.

Rotation axis 'A' may align with the points where the inner protrusions 8124 are inserted into the outer connecting holes 8144, but the present disclosure is not so limited.

The power transmit portion 816 may incorporate the transmission protrusions 8182 and the inner protrusions 8164.

The transmission protrusions 8162 may be electrically connected to the third link patterns 230 of the blade housing 120.

The electrical connection may remain unchanged between the transmission protrusion 8182 and the third link pattern 230 while the cartridge connection 812 or the razor cartridge 10 rotates around rotation axis 'A'.

Thus, the heated area 210 of the razor cartridge 10 can maintain a heating state continuously, regardless of the degree of rotation of the razor cartridge 10.

The inner protrusions 8164 may be formed inside the power transmit portions 816, and may be inserted into the outer connecting holes 8144 of the connecting plate 814.

One side of the power transmit portion 816 may be electrically connected to the electric wire 824 extending from the power supply 822.

The power transmit portion 816 may receive power from the power supply 822 through the electric wire 824. This power may be transmitted to the third link patterns 230 through the transmission protrusions 8162.

Figure 9:
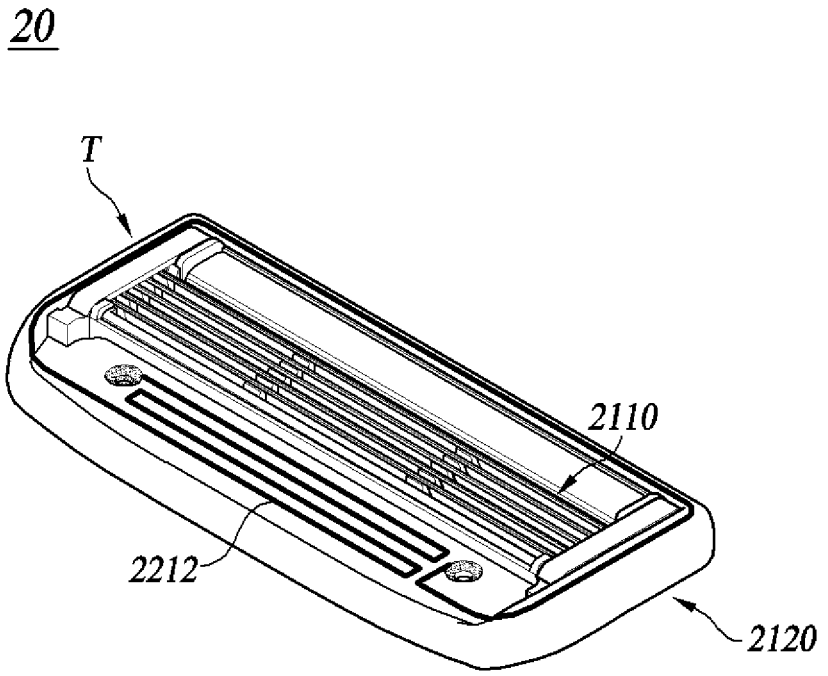
FIG. 9 is a front perspective view of a razor cartridge according to another embodiment of the present disclosure.
Figure 10:
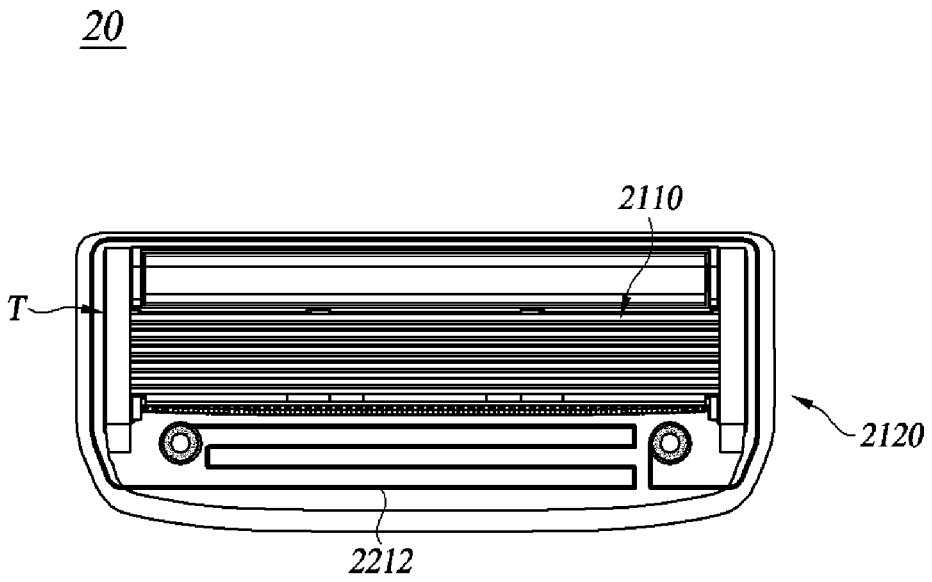
FIG. 10 is a front view of a razor cartridge according to another embodiment of the present disclosure.

Another embodiment of the present disclosure shown in FIGS. 9 and 10 includes the first heating pattern formed to surround the top side of the blade housing, or rear of the blade housing with respect to the shaving direction. The following will omit repeated description of features substantially the same as the aforementioned embodiments of the present disclosure.

FIG. 9 is a front perspective view of a razor cartridge 20 according to another embodiment of the present disclosure.

FIG. 10 is a front view of the razor cartridge 20 according to another embodiment of the present disclosure.

In FIGS. 9 and 10, for convenience of description, the anterior guard is omitted.

FIGS. 9 and 10 show a first heating pattern 2212 disposed to surround front side 'T' of a blade housing 2120.

Specifically, the first heating pattern 2212 may be deployed at front side 'T' of the blade housing 2120 not only in front of the shaving blade 2110 with respect to the shaving direction, but also behind the shaving blade 2110 as well as at the sides thereof.

In this case, front side 'T' of the blade housing 2120 may generate heat by not only at the front of the shaving blade 2110 but behind and at the side regions thereof. This effects, when shaving, heating the user's skin over a wider area.

FIGS. 9 and 10 illustrate the first heating pattern 2212 as being composed of a single conducting wire, but the present disclosure is not so limited.

For example, the first heating pattern 2212 may be composed of a plurality of conducting wires, wherein each wire may be disposed in one of a rear region and side regions of the shaving blade 2110.

In FIGS. 9 and 10, the first heating pattern 2212 is illustrated as being disposed to surround the entire circumference of front side 'T' of the blade housing 2120, but the present disclosure is not so limited.

For example, the first heating pattern 2212 may be disposed only on some of the circumference of front side 'T' of the blade housing 2120.

Figure 11:
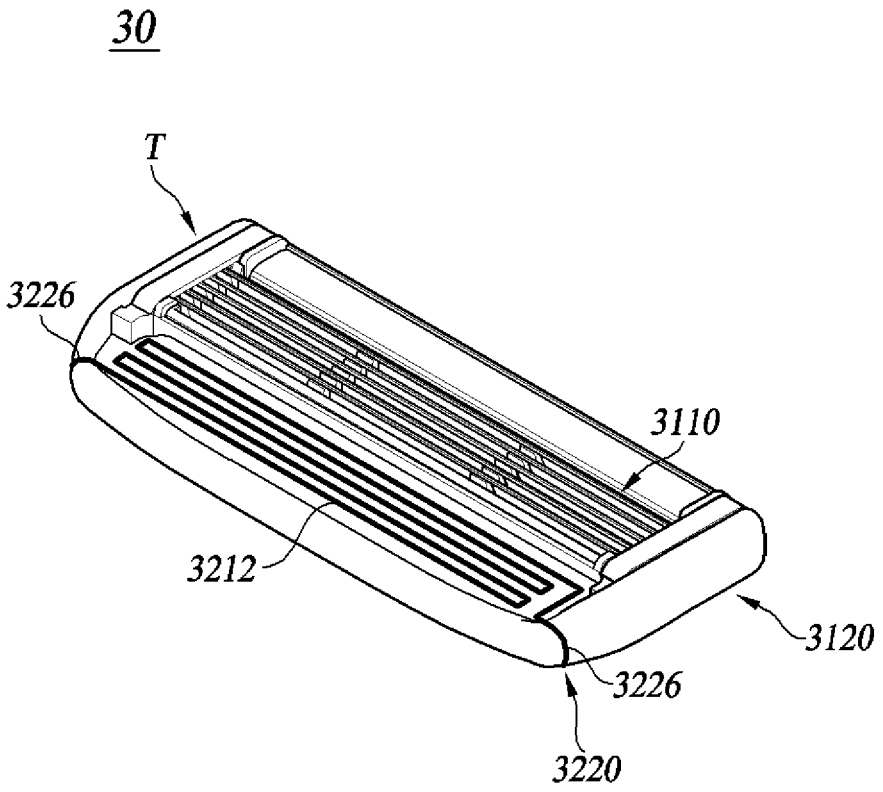
FIG. 11 is a front perspective view of a razor cartridge according to yet another embodiment of the present disclosure.
Figure 12:
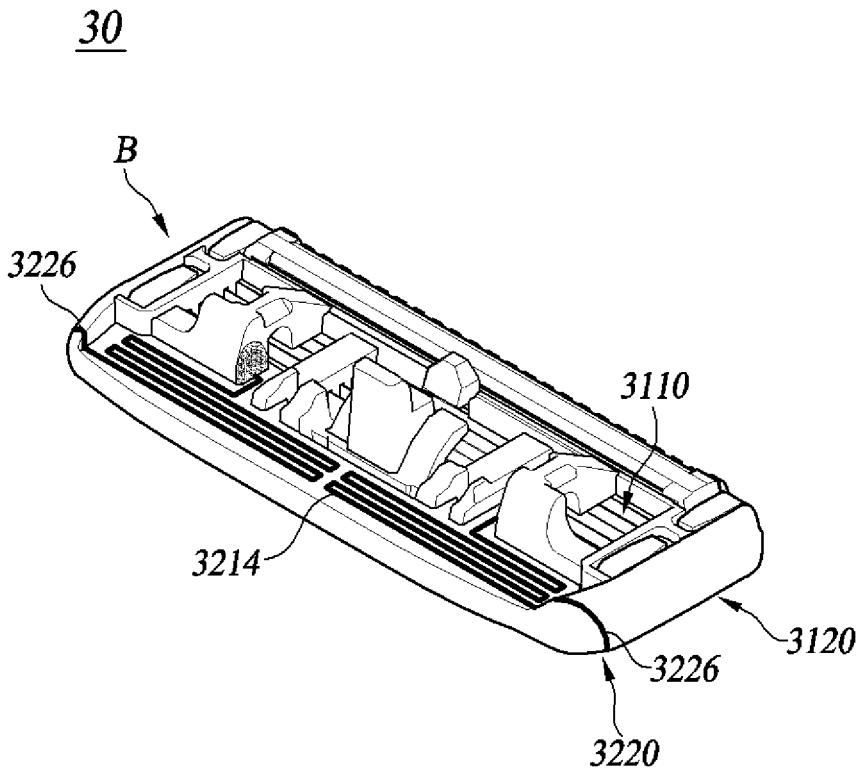
FIG. 12 is a rear perspective view of a razor cartridge according to yet another embodiment of the present disclosure.

Yet another embodiment of the present disclosure shown in FIGS. 11 and 12 includes the heating patterns on opposite sides of the blade housing are electrically connected by a detouring link pattern that bypasses along the lateral surface of the blade housing. The following description will omit a repeated description of features substantially the same as the aforementioned embodiments of the present disclosure.

FIG. 11 is a front perspective view of a razor cartridge 30 according to yet another embodiment of the present disclosure.

FIG. 12 is a rear perspective view of the razor cartridge 30 according to yet another embodiment of the present disclosure.

FIGS. 11 and 12 shows a pattern link 3220 which includes a plurality of detouring link patterns 3226 bypassing along the lateral surfaces of a blade housing 3120.

The blade housing 3120 may have a first heating pattern 3212 and a second heating pattern 3214 which are electrically connected to the plurality of detouring link patterns 3226, thereby electrically interconnecting the first heating pattern 3212 and the second heating pattern.

The multiple detouring link patterns 3262 are similar to the first heating pattern 3212 and the second heating pattern 3214 in that they employ the MID or LDS method using the printing or laser etching and electroless plating processes, to be integrally formed with the blade housing 3120.

In this case, in order to protect the detouring link patterns 3326 exposed on the outside of the blade housing 3120, the detouring link patterns 3326 may be coated with an insulating or a protective film.

FIGS. 11 and 12 illustrate the detouring link patterns 3226 as bypassing along the lateral surfaces of the blade housing 3120, which are positioned laterally of the shaving blade 3110, but the present disclosure is not so limited.

For example, the detouring link pattern 3226 may be configured to bypass along the lateral surfaces of the blade housing 3120, which are positioned forward or rearward of the shaving blade 3110 with respect to the shaving direction.

The razor cartridge 30 according to yet another embodiment of the present disclosure is desirably configured such that the detouring link patterns 3226 are formed as an integral part of a lateral surface of the blade housing 3120, which is achieved by employing the MID or LDS method using printing or laser etching and electroless plating processes. This effects improved efficiency during production and durability of the razor cartridge 30.

As described above, according to some embodiments of the present disclosure, the heated area as being formed integrally with the blade housing can provide an accurate and comfortable shaving for the user and improve the productivity and durability of the razor cartridge.

Although exemplary embodiments of the present disclosure have been described for illustrative purposes, those skilled in the art will appreciate that various modifications, additions and substitutions are possible, without departing from the idea and scope of the claimed invention. Therefore, exemplary embodiments of the present disclosure have been described for the sake of brevity and clarity. The scope of the technical idea of the present embodiments is not limited by the illustrations. Accordingly, one of ordinary skill would understand the scope of the claimed invention is not to be limited by the above explicitly described embodiments but by the claims and equivalents thereof.

What is claimed is:

1. A razor cartridge, comprising:

at least one shaving blade having a cutting edge;

a blade housing configured to accommodate the at least one shaving blade aligned in a transverse direction;

a heated area formed at the blade housing, and comprising at least one heating pattern made of a conductive material; and a non-heated area formed at the blade housing made of a material different from the heated area, wherein the conductive material included in the at least one heating pattern comprises one or more conductive plastics or metallic materials, wherein the heated area is configured to generate heat by receiving electric power from a power supply, and wherein the heated area and the non-heated area are integrally formed with the blade housing.

2. The razor cartridge of claim 1, wherein the conductive material included in the at least one heating pattern is printed or plated on the blade housing to be integrally formed with the blade housing.

3. The razor cartridge of claim 1, wherein the at least one heating pattern comprises:

a first heating pattern disposed at a front side of the blade housing.

4. The razor cartridge of claim 3, further comprising:

an anterior guard disposed at the front side of the blade housing and configured to cover at least some of the heated area, wherein the anterior guard is positioned in front of the at least one shaving blade with respect to a shaving direction.

5. The razor cartridge of claim 4, wherein the first heating pattern is covered by the anterior guard so as not to be externally exposed.

6. A razor cartridge, comprising:

at least one shaving blade having a cutting edge;

a blade housing configured to accommodate the at least one shaving blade aligned in a transverse direction;

a heated area formed at the blade housing, and comprising at least one heating pattern made of a conductive material; and a non-heated area formed at the blade housing made of a material different from the heated area, wherein the conductive material included in the at least one heating pattern comprises one or more conductive plastics or metallic materials, wherein the heated area is configured to generate heat by receiving electric power from a power supply, and wherein the at least one heating pattern comprises:

a first heating pattern disposed at a front side of the blade housing; and a second heating pattern disposed at a rear side of the blade housing.

7. The razor cartridge of claim 6, wherein a position of at least a portion of the second heating pattern at the rear side of the blade housing overlaps with a position of at least a portion of the first heating pattern at the front side of the blade housing.

8. The razor cartridge of claim 6, wherein the blade housing further comprises:

a pattern link configured to electrically connect the first heating pattern with the second heating pattern.

9. The razor cartridge of claim 3, wherein the first heating pattern is formed in a meandering pattern, and at least some of the first heating pattern has adjacent pattern lines with a spacing in a range of 0.01 mm to 40 mm.

10. The razor cartridge of claim 1, wherein the conductive material has a resistance value in a range of 1Ω to 20Ω.

11. A razor assembly, comprising:

a razor cartridge comprising:

at least one shaving blade having a cutting edge;

a blade housing configured to accommodate the at least one shaving blade aligned in a transverse direction and comprising a first heating pattern and a second heating pattern, wherein the first heating pattern and the second heating pattern are configured to generate heat by receiving electric power from a power supply; and a razor handle coupled to the razor cartridge, wherein the blade housing further comprises a link pattern at the rear side of the blade housing and electrically connected with the second heating pattern, and wherein the razor handle comprises a power transmit portion electrically connected with the link pattern.

12. The razor assembly of claim 11, wherein the razor cartridge is configured to be detachably coupled to the razor handle, and configured to pivot between a first position and a second position with respect to the razor handle about a rotation axis parallel to the transverse direction.

13. The razor assembly of claim 12, wherein the link pattern and the power transmit portion are configured to remain electrically connected during pivot of the razor cartridge between the first position and the second position.

* * * * *